US012276071B2

(12) United States Patent
Saenko et al.

(10) Patent No.: US 12,276,071 B2
(45) Date of Patent: Apr. 15, 2025

(54) METHOD FOR HEATING AND DISPENSING ASPHALT IN AN ABOVEGROUND ASPHALT STORAGE FACILITY

(71) Applicant: LIMITED LIABILITY COMPANY "ENERGY EFFICIENT BITUMEN TECHNOLOGIES" (LLC "EBT"), Moscow (RU)

(72) Inventors: Sergey Sergeevich Saenko, Rostov-on-Don (RU); Yuri Yakovlevich Nikulin, Rostov-on-Don (RU)

(73) Assignee: LIMITED LIABILITY COMPANY ENERGY EFFICIENT BITUMEN TECHNOLOGIES, Moskow (RU)

( * ) Notice: Subject to any disclaimer, the term of this patent is extended or adjusted under 35 U.S.C. 154(b) by 0 days.

(21) Appl. No.: 18/034,427

(22) PCT Filed: Oct. 5, 2021

(86) PCT No.: PCT/RU2021/050326
§ 371 (c)(1),
(2) Date: Apr. 28, 2023

(87) PCT Pub. No.: WO2022/093075
PCT Pub. Date: May 5, 2022

(65) Prior Publication Data

US 2024/0295084 A1 Sep. 5, 2024

(30) Foreign Application Priority Data

Oct. 28, 2020 (RU) ..... 2020135335

(51) Int. Cl.
*E01C 19/08* (2006.01)
*C10C 3/10* (2006.01)

(52) U.S. Cl.
CPC ..... *E01C 19/08* (2013.01); *C10C 3/10* (2013.01)

(58) Field of Classification Search
CPC ... C10C 3/00; C10C 3/10; E01C 19/02; E01C 19/08
See application file for complete search history.

(56) References Cited

U.S. PATENT DOCUMENTS 1,514,252 A * 11/1924 Fellmann ..... E01C 19/08 126/343.5 A
2,396,578 A * 3/1946 Kittel ..... B01J 6/005 366/147

(Continued)

FOREIGN PATENT DOCUMENTS

CN 102002903 A * 4/2011 ..... E01C 19/02
KR 101005922 B1 * 1/2011 ..... E01C 19/08

(Continued)

OTHER PUBLICATIONS

Michael Maddox, Moving Liquid Around the Terminal, Asphalt PRO, site visited on Apr. 15, 2019, online, available from internet https://theasphaltpro.com/articles/moving-liquid-around-the-terminal.

(Continued)

*Primary Examiner* — Nicolas A Arnett
(74) *Attorney, Agent, or Firm* — Brett A. Schenck

(57) ABSTRACT

A method of heating and dispensing bitumen in a storage tank and bitumen terminal in that bitumen is heated in the storage tank and in a casing installed in the tank to a temperature of in-plant transportation of at least 80° C. Bitumen is heated and maintained by heaters in the main storage tank volume outside the casing with an intake and drain pipe of the tank at a temperature not lower than the flow temperature of 60° C. Bitumen is fed from the casing to the working tank main volume as the bitumen is dis- (Continued)

charged from the working tank. Bitumen is heated in a casing in the working tank to a working temperature of not less than 140° C. with subsequent release to external transport or in the technological process. Bitumen is heated in the main working tank main volume to a temperature not lower than 80° C.

1 Claim, 3 Drawing Sheets

(56) References Cited

U.S. PATENT DOCUMENTS 4,620,645 A * 11/1986 Hale ..... E01C 19/174
222/146.2
7,384,181 B1 * 6/2008 Collette ..... E01C 19/1004
366/147
2018/0119024 A1 * 5/2018 Berg ..... C10G 7/00
2019/0169505 A1 * 6/2019 Berg ..... C09D 195/00

FOREIGN PATENT DOCUMENTS

RU 84016 U1 * 3/2009 ..... C01C 3/12
RU 134943 U1 11/2013
RU 148797 U1 12/2014
RU 150050 U1 1/2015

OTHER PUBLICATIONS

The International Search Report (with English translation) and the Written Opinion (with English translation) of the International Searching Authority, or the Declaration for International Application No. PCT/RU2021/050326, Dec. 23, 2021.

* cited by examiner

METHOD FOR HEATING AND DISPENSING ASPHALT IN AN ABOVEGROUND ASPHALT STORAGE FACILITY

The invention relates to the field of road construction. The invention relates to the storage and heating of bitumen. Bitumen is stored in above-ground bitumen storages and then heated to a working condition (operating temperature). Bitumen is stored with subsequent shipment to external transport or to the technological process.

The method of bitumen preparation at the terminals is known (Moving Liquid Around the Terminal [electronic resource]/Asphalt PRO: URL: https://theasphaltpro.com/articles/moving-liquidaround-the-terminal/(date of reference: 15 Apr. 2019)).

This Method Includes:

- heating or maintaining bitumen in large volume tanks (up to 10,000 m3). This occurs at in-plant conveying temperatures. Not below the pumping temperature of the bitumen pump (from 80° C.);
- pumping to intensive heating tanks (day tanks). The volume is equal to the daily loading capacity of the terminal;
- heating to the required shipment temperature. Working temperature (not less than 140° C.) for no more than a day;
- shipment to external transport or to the process.

The closest technical solution is an above-ground bitumen storage tank. Inside the asphalt storage is placed a shell with the intake and drain pipe, heaters, temperature level sensors (Patent RU Nº 150050 E 01 C 19/08, Published 27 Jan. 2015 Bulletin Nº 3). Bitumen preparation process is carried out by heating the main stored mass (outside the casing). Heating to a flow temperature of 60-165° C. Heating, followed by bringing to a temperature of 100-105° C. of the local volume under the casing with the intake and drain pipe. Discharge into horizontal or vertical tanks of intensive heating. Here it is heated to a working temperature (not less than 140° C.). It is also discharged to an external transport or technological process.

However, this technical solution of heating and dispensing bitumen has the following disadvantages:

- heat losses to the environment. Losses from the surface of intensive heating tanks;
- bitumen aging due to oxidation through the large area of the bitumen mirror in the intensive heating tanks.

The task of the proposed invention is to reduce energy costs while maintaining the quality of bitumen.

The essence of the invention is a method of heating and dispensing bitumen in an above-ground bitumen storage tank and bitumen terminal. The essence of the invention is that bitumen is heated in a storage tank in a casing installed in it with an intake and drain pipe. Heating to the temperature of in-plant transportation is not lower than 80° C. In the main storage tank volume, outside the casing with the intake and drain pipe, bitumen is heated and maintained by heaters. Heating bitumen at a temperature no lower than the flow temperature 60° C. Bitumen supply is carried out as bitumen is dispensed from the working tank. Bitumen supply from the volume under the casing with the intake and drainage drain pipe of the storage tank in the main volume of the working tank. A heating of bitumen in the working tank is carried out in a casing installed in it with the intake and drain pipe.

Heating bitumen to an operating temperature of at least 140° C. Heating with subsequent release to external transport or in the technological process. In the main volume of the working tank, outside the casing with the intake and drain pipe, bitumen is heated to the temperature of in-plant transportation of bitumen not lower than 80° C. Heating is maintained by heaters.

Or the bitumen in the storage tank is heated and maintained by heaters throughout the storage tank. Heating is maintained at a temperature of in-plant transportation at least 80° C. Bitumen is fed into the main volume of the working tank as bitumen is consumed from the working tank. A heating of bitumen in the working tank is carried out in a casing installed in it with the intake and drain pipe. The bitumen is heated to a working temperature of at least 140° C. Heating is followed by discharging to an external transport or technological process. In the main volume of the working tank outside the casing with the intake and drain pipe heating of bitumen is carried out to the temperature of bitumen for in-plant transportation is not below 80° C. Heating is maintained by heaters.

Or the bitumen in the working tank is heated under the casing with the intake and drain pipe. Heating is carried out to a working temperature of not less than 140° C. Heating is carried out with the subsequent release to an external transport or in the technological process. In the main volume of the working tank, outside the casing with the intake and drain pipe, the bitumen is heated and maintained by heaters. Heating at the temperature of in-plant transportation of bitumen is not lower than 80° C.

TECHNICAL RESULT

Technical result-reduction of energy costs is achieved by using a shell casing with an intake and drain pipe in the working tank for intensive heating of bitumen. Heating bitumen to the temperature of shipment to external transport or in the process (operating temperature).

The technical result is also achieved by excluding the intensive heating tanks from the technological process.

The technical result is also achieved by installing the casing with the intake and drain pipe in the storage tank. Installation of the casing to bring bitumen to the temperature of in-plant transportation of bitumen. This provides a reduction in heat loss. Since the heat loss from the surface of the casing is useful. The heat loss is used to reheat the bitumen in the main volume of the storage tank and working tank.

The technical result is also achieved by preserving the quality of bitumen. Preservation of quality by reducing the contact area of bitumen at high temperature with oxygen. Since the cross-sectional area of the intake and drain pipe is tens of times less than the surface area of bitumen in the tank.

The Specified Task is Achieved:

- Exclusion of intensive heating tanks from the technological process. Exclusion by installing the casing with the intake and drain pipe in the center of the working tank. This is necessary to heat the local volume of bitumen under the casing with the intake and drain pipe. Heating to the temperatures of the shipment to external transport or in the process (not less than 140° C.). The heat loss is useful. The heat loss provides additional heating and maintains the temperature of asphalt in the main volume of the working tank outside the casing. A contact area of bitumen with oxygen in the intake and drain pipe is dozens of times less than the surface area of bitumen in the intensive heating tanks.
- installation of the casing with the intake and drain pipe in the center of the storage tank. Heating to the temperature of in-plant bitumen transportation (not lower than 80° C.). Heating only the local volume of bitumen under the casing with the intake and drain pipe. The heat loss is useful. The heat loss provides reheating and maintaining the temperature of bitumen in the main volume of the storage tank outside the casing.

The essence of the invention is explained in the drawings.

Figure 1:
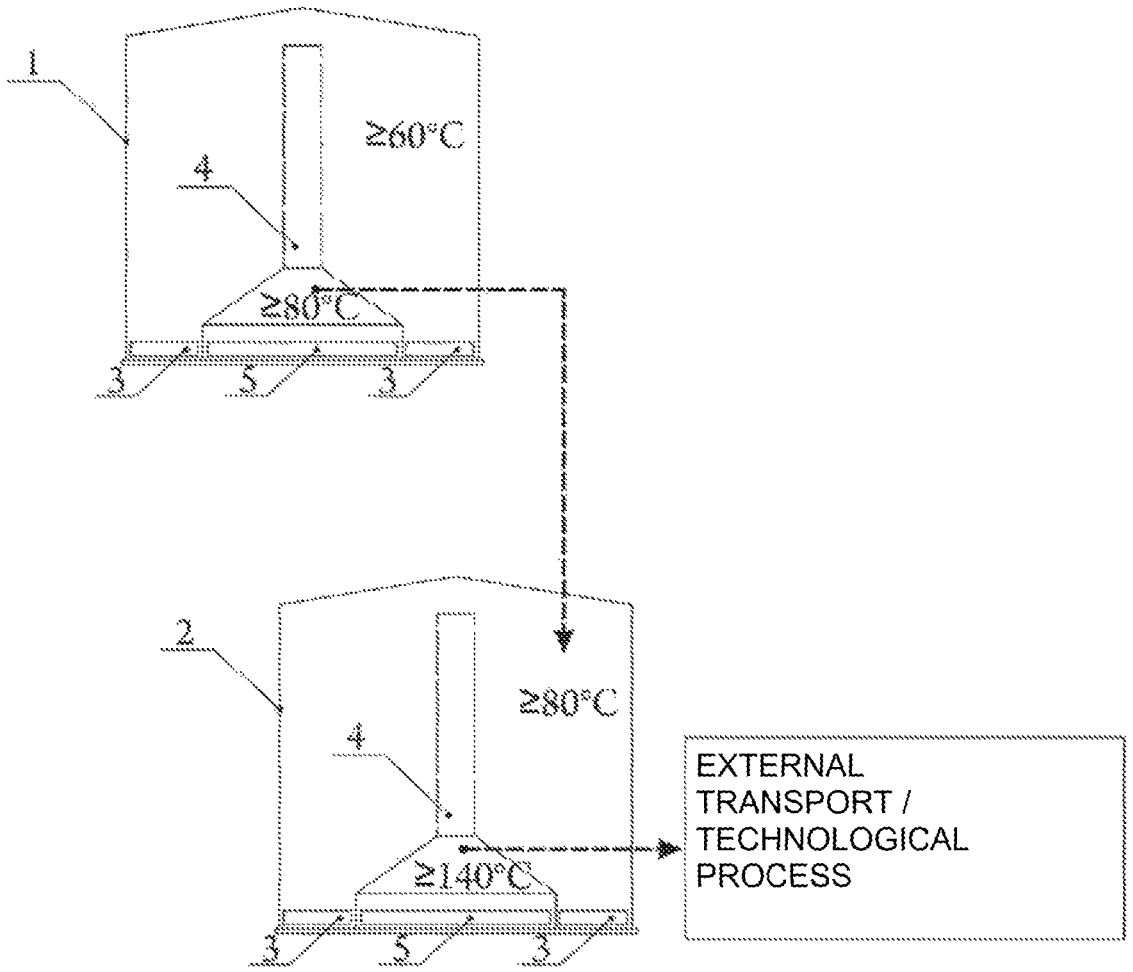
FIG. 1 shows a flowchart of the method.

Technological equipment for the implementation of the method includes:

storage tank 1;

working tank 2 with heaters 3 in the main volume of the tank, casing 4 with the intake-drain pipe and heaters 5 under the casing.

The method is carried out as follows.

For a terminal with a storage tank and a working tank, the method is carried out according to the scheme in FIG. 1. The tanks are equipped with casings with intake and drain pipes. Filled with bitumen working tank 2 is a preparatory operation. Operations prior to the release of bitumen to external transport or in the process:

bitumen in the main volume of the working tank 2 is heated to the temperature of in-plant transportation. It is heated outside the casing 4 with the intake and drain pipe. Heating by heaters 3 in the main volume of the working tank 2 at least 80° C.

bitumen in the local volume is heated in the casing 4 with the intake and drain pipe. Bitumen is heated by heaters 5 under the casing 4 with the intake and drain pipe of the working tank 2. Heated to a shipment temperature of not less than 140° C.

Bitumen is taken by pumps and fed to external transport or to the technological process. As bitumen is taken from under the casing 4 with the intake and drain pipe of the working tank 2, bitumen flows by gravity to its place. Bitumen comes from the main volume outside the casing of the working tank 2. When the level of bitumen in the working tank 2 to the top mark of the casing 4 with the intake and drain pipe, bitumen in the main volume of the working tank 2 is replenished from the local volume of the casing 4 with the intake and drain pipe of the storage tank 1. This is to ensure the equal delivery of bitumen to external transportation or technological process. For this purpose, bitumen is preheated in the storage tank 1. Warmed up by heaters 3 the main volume of the storage tank 1. Bitumen is heated outside the casing 4 with the intake and drain pipe. It is heated to a flow temperature not lower than 60° C. This ensures that the bitumen flows by gravity under the casing 4 with the intake and drain pipe of the storage tank 1. Bitumen is also heated to the temperature of in-plant transportation (not lower than 80° C.). Bitumen is heated in the casing 4 with the intake and drain pipe of the storage tank 1. It is heated by heaters 5 under the casing 4 with the intake and drain pipe of the storage tank 1.

Figure 2:
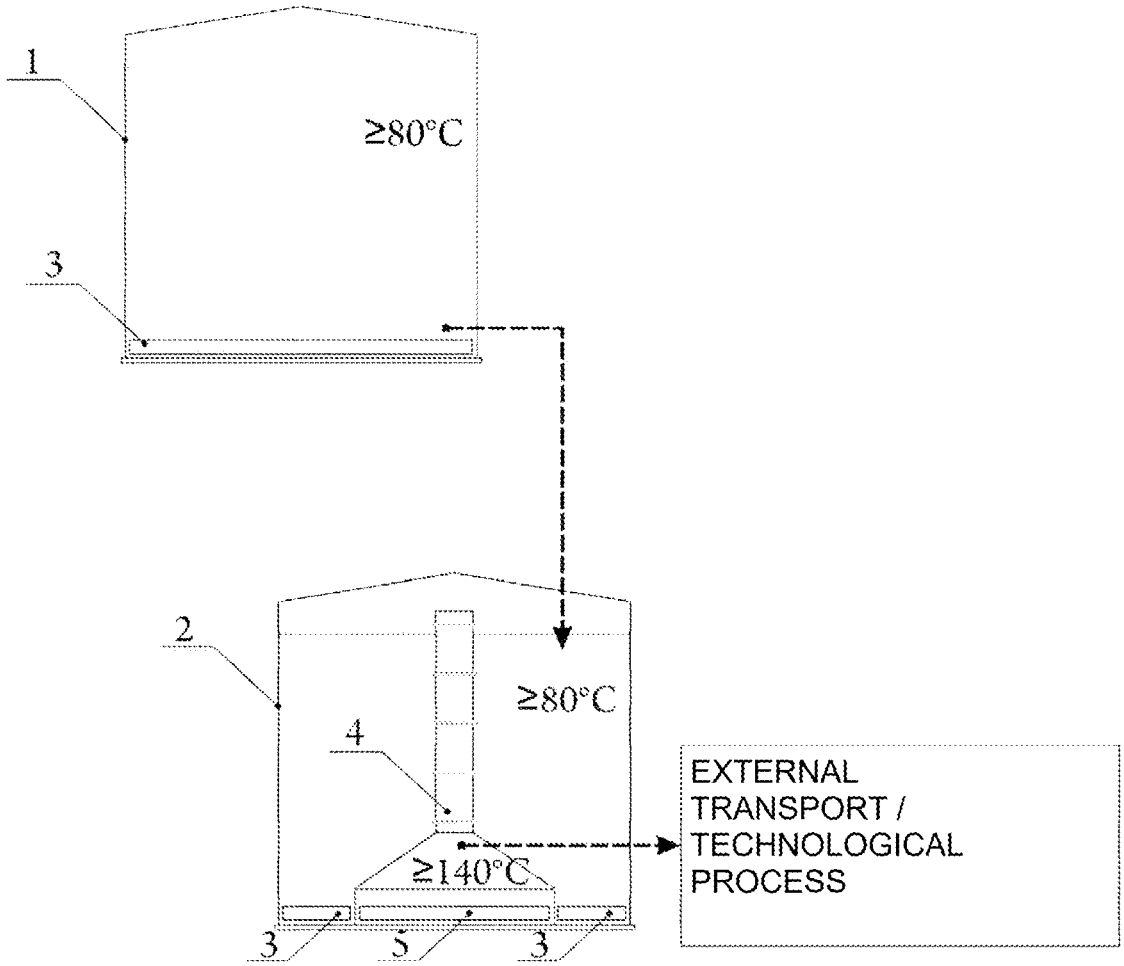
FIG. 2 shows a scheme of implementing the method. Schematic without the hood with the intake and drain pipe in the storage tank.

As bitumen is dispensed into the main volume of the working tank 2, bitumen from the main volume of the storage tank 1 flows by gravity to its place. Bitumen is dispensed from under the casing 4 with the intake and drain pipe of the storage tank 1. For the particular case of the bitumen terminal, with the storage tank without the casing with the intake and drain pipe, the method is carried out according to the scheme in FIG. 2. And for the working tank, the method is carried out according to the diagram in FIG. 2. The tank is installed in a casing with the intake and drain pipe. Filled with bitumen working tank 2 undergoes preparatory operations. Operations before the release of bitumen to external transport or in the process:

bitumen in the main volume of the working tank 2 is heated to the temperature of in-plant transportation. It is heated outside the casing 4 with the intake and drain pipe. Heated at least 80° C. by heaters 3 in the main volume of the working tank 2.

bitumen in the local volume is heated in the casing 4 with the intake and drain pipe. Bitumen is heated by heaters 5 under the casing 4 with the intake and drain pipe of the working tank 2. Heated to a shipment temperature of not less than 140° C.

Bitumen is taken by pumps and fed to external transport or to the technological process. As bitumen is taken from under the casing 4 with the intake and drain pipe of the working tank 2, bitumen flows by gravity to its place. Bitumen comes from the main volume outside the casing of the working tank 2. When the level of bitumen in the working tank 2 to the top mark of the casing 4 with the intake and drain pipe, bitumen in the main volume of the working tank 2 is replenished from the local volume of the casing 4 with the intake and drain pipe of the storage tank 1. This is to ensure the equal delivery of bitumen to external transportation or technological process. For this purpose, bitumen is preheated in the storage tank 1. Heated by heaters 3 the main volume of the storage tank 1. It is heated to a flow temperature of not less than 80° C. This temperature provides pumping or gravity feed of bitumen into the main volume of the working tank 2.

Figure 3:
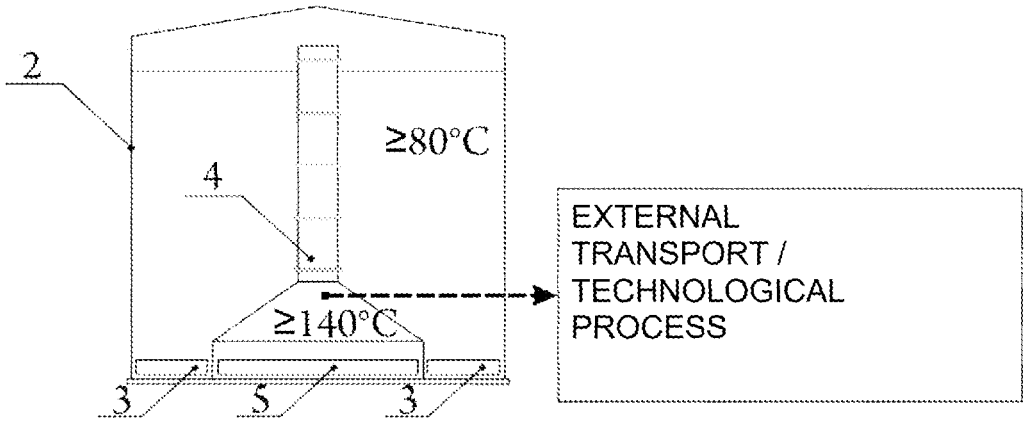
FIG. 3 shows a schematic of the method for a terminal without a storage tank.

For the particular case of bitumen terminal applies the scheme of implementation of the method according to FIG. 3. Terminal with one tank or with the number of tanks corresponding to the number of stored bitumen grades. According to the scheme, each tank of the terminal is a working tank. A casing with an intake and discharge pipe is installed in the tank. Filled with bitumen, the working tank 2 undergoes preparatory operations. Operations before the beginning of the release of bitumen to external transport or in the process:

bitumen in the main volume of the working tank 2 is heated to the temperature of in-plant transportation. It is heated outside the casing 4 with the intake and drain pipe. Heated at least 80° C. by heaters 3 in the main volume of the working tank 2.

bitumen in the local volume is heated in the casing 4 with the intake and drain pipe. Bitumen is heated by heaters 5 under the casing 4 with the intake and drain pipe of the working tank 2. Heated to a shipment temperature of not less than 140° C.

Bitumen is taken by pumps and fed to external transport or to the technological process. As bitumen is taken from under the casing 4 with the intake and drain pipe of the working tank 2, bitumen flows by gravity to its place. Bitumen comes from the main volume outside the casing of the working tank 2.

Introduction of the casing with the intake and drain pipe in the working tank and bringing bitumen in it to the temperatures of shipment to external transport or in the process allows to exclude horizontal or vertical tanks of intensive heating. The introduction of the casing allows for a reduction in energy consumption. Reducing at the expense of useful use of heat loss from the casing with the intake and drain pipe for heating bitumen in the main storage volume.

The introduction of the casing allows to ensure the preservation of bitumen quality. Preservation of quality due to the use of the casing with the intake and drain pipe. Use at the high-temperature stage of preparation. The pipe has a much smaller bitumen mirror area (oxidation area) than in horizontal or vertical tanks of intensive heating.

Introduction of the casing with the intake and drain pipe into the storage tank and heating to the temperature of in-plant bitumen transportation provides a reduction of energy consumption. Heating only the local volume of bitumen under the casing with the intake and drain pipe. The heat loss from the casing with the intake and drain pipe is useful. The heat loss ensures that the bitumen in the main volume of the storage tank is warmed up and maintains its temperature.

The invention claimed is:

1. A method of heating and dispensing bitumen in an above-ground bitumen storage and bitumen terminal comprising:

heating bitumen in a storage tank in a storage tank casing installed in the storage tank with a storage tank intake and drain pipe to a temperature of in-plant transportation of not less than 80° C.;

heating bitumen in a main storage tank volume of the storage tank outside the storage tank casing with the storage tank intake and drain pipe to a temperature of not lower than 60° C. and maintaining that temperature by storage tank heaters;

supplying the bitumen from the main storage tank volume of the storage tank under the storage tank casing with the storage tank intake and drain pipe of the storage tank to a main working tank volume of a working tank as the bitumen is dispensed from the working tank;

heating the bitumen in the working tank within a working tank casing installed in the working tank with a working tank intake and drain pipe to a working temperature of not less than 140° C.;

heating the bitumen in the main working tank volume of the working tank outside the working tank casing with the working tank intake and drain pipe to a temperature of not lower than 80° C. for in-plant transportation of the bitumen with subsequent release of the bitumen to an external transport or in a technological process, wherein heating the bitumen in the main working tank volume of the working tank is maintain by working tank heaters;

heating the bitumen in the storage tank by the storage tank heaters throughout the storage tank, wherein the bitumen is transported at a temperature not lower than 80° C. and the bitumen is fed into the main working tank volume of the working tank as used bitumen from the working tank, wherein heating the bitumen is maintained by the storage tank heaters and the bitumen in the working tank is heated under the working tank casing with the working tank intake and drain pipe to a working temperature of not less than 140° C., wherein the heating of the bitumen is conducted with subsequent release of the bitumen on the external transport or in the technological process, wherein the bitumen in the main working tank volume of the working tank outside the working tank casing with the working tank intake and drain pipe is heated and maintained by the working tank heaters at a temperature of in-plant transportation of the bitumen of not lower than 80° C.

* * * * *